US011674358B2

(12) United States Patent
Juranitch et al.

(10) Patent No.: US 11,674,358 B2
(45) **Date of Patent: *Jun. 13, 2023**

(54) COMPLETIONS FOR WELL ZONE CONTROL

(71) Applicant: XDI Holdings, LLC, Bedford, NH (US)

(72) Inventors: James C. Juranitch, Fort Lauderdale, FL (US); Alan C. Reynolds, Novi, MI (US)

(73) Assignee: XDI Holdings, LLC, Bedford, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/318,744

(22) Filed: May 12, 2021

(65) Prior Publication Data

US 2022/0065051 A1 Mar. 3, 2022

Related U.S. Application Data

(63) Continuation of application No. 16/346,439, filed as application No. PCT/US2017/059501 on Nov. 1, 2017, now Pat. No. 11,035,181.

(60) Provisional application No. 62/416,095, filed on Nov. 1, 2016.

(51) Int. Cl.

| | |
|---|---|
| ***E21B 43/24*** | (2006.01) |
| ***E21B 17/07*** | (2006.01) |
| ***E21B 34/02*** | (2006.01) |

(52) U.S. Cl.

CPC ..... *E21B 17/07* (2013.01); *E21B 34/02* (2013.01); *E21B 43/2406* (2013.01)

(58) Field of Classification Search

CPC ..... E21B 43/162; E21B 43/24; E21B 34/16

See application file for complete search history.

(56) References Cited

U.S. PATENT DOCUMENTS

| | | | |
|---|---|---|---|
| 2,227,539 | A | 1/1941 | Dorton |
| 4,399,865 | A | 8/1983 | Anderson et al. |
| 4,646,828 | A | 3/1987 | Schwab, Jr. et al. |
| 4,648,455 | A | 3/1987 | Luke |
| 4,711,304 | A | 12/1987 | Boeke et al. |
| 5,024,275 | A | 6/1991 | Anderson et al. |
| 6,070,663 | A | 6/2000 | Cernocky et al. |
| 2003/0131989 | A1 | 7/2003 | Zakiewicz |

(Continued)

FOREIGN PATENT DOCUMENTS

| | | | |
|---|---|---|---|
| WO | 2015153705 | A1 | 10/2015 |
| WO | 2017151640 | A1 | 9/2017 |

*Primary Examiner* — Shane Bomar

(74) *Attorney, Agent, or Firm* — Dykema Gossett PLLC

(57) ABSTRACT

Various embodiments of the present disclosure include a system, method, and apparatus for increased control of steam injection for use in oil and gas recovery in a well. Embodiments can comprise a plurality of controllable zones of injection disposed in the well. The plurality of controllable zones include a primary conduit that houses a plurality of concentric conduits of decreasing diameter disposed inside of the primary conduit. In some embodiments, each of the concentric conduits includes a proximal end and a distal end. In some embodiments, each of the plurality of concentric conduits are fluidly sealed from one another from their respective proximal end to distal end.

14 Claims, 4 Drawing Sheets

(56) References Cited

U.S. PATENT DOCUMENTS

| | | | | |
|---|---|---|---|---|
| 2006/0175061 | A1* | 8/2006 | Crichlow | E21B 43/2406 166/302 |
| 2007/0175638 | A1* | 8/2007 | Crichlow | E21B 43/24 166/302 |
| 2009/0272129 | A1 | 11/2009 | Petty | |
| 2011/0024102 | A1 | 2/2011 | Ring | |
| 2013/0255943 | A1 | 10/2013 | Yeh et al. | |
| 2017/0241247 | A1 | 8/2017 | Parrella | |
| 2019/0063200 | A1 | 2/2019 | Juranitch | |
| 2022/0042405 | A1* | 2/2022 | Juranitch | E21B 43/2406 |

* cited by examiner

COMPLETIONS FOR WELL ZONE CONTROL

CROSS-REFERENCE TO RELATED APPLICATIONS

This application is a continuation of U.S. application Ser. No. 16/346,439, filed 30 Apr. 2019 (the '439 application), which is the national stage application of International application no. PCT/US2017/059501, filed 1 Nov. 2017 (the '501 application) and published under International publication no. WO 2018/085373 A1 on 11 May 2018. This application claims the benefit of United States provisional application No. 62/416,095, filed 1 Nov. 2016 (the '095 application). The '439 application, '501 application and the '095 application are all hereby incorporated by reference in their entirety as though fully set forth herein.

FIELD

Embodiments of the present disclosure generally relate to a system, method, and apparatus used for hydrocarbon well completion.

BACKGROUND

Steam can be generated by methods that employ devices such as Once Through Steam Generators (OTSG), Direct Steam Generators (DSG), Drum Boilers, among other devices. These methods can use a pipe or tube to inject steam into a reservoir containing oil or gas to form a chamber below ground in a reservoir or to generally reduce the viscosity of the desired bitumen or heavy hydrocarbons to facilitate recovery of the valued energy asset. In some embodiments, these methods can be used in Steam Assisted Gravity Drain (SAGD) bitumen production, and/or Cyclic Steam Stimulation (CSS) processes, Steam Flood and other oil and gas recovery processes.

SUMMARY

Various embodiments of the present disclosure include a system for increased control of steam injection for use in oil and gas recovery in a well. The system can comprise a plurality of controllable zones of injection disposed in the well. The plurality of controllable zones include a primary conduit that houses a plurality of concentric conduits of decreasing diameter disposed inside of the primary conduit. In some embodiments, each of the concentric conduits includes a proximal end and a distal end. In some embodiments, each of the plurality of concentric conduits are fluidly sealed from one another from their respective proximal end to distal end.

Various embodiments of the present disclosure include a system for increased control of steam injection for use in oil and gas recovery in a well. The system can comprise a plurality of controllable zones of injection disposed in the well. The plurality of controllable zones can include a primary conduit that houses a plurality of concentric conduits of decreasing diameter disposed inside of the primary conduit. Each of the concentric conduits includes a proximal end and a distal end. The plurality of concentric conduits are fluidly sealed from one another from their respective proximal end to their distal end. The primary conduit and the plurality of concentric conduits disposed inside of the primary conduit include a plurality of modular sections of conduit fluidly coupled with one another via compression couplings.

DETAILED DESCRIPTION

This disclosure presents a better, more effective completion system, method, and apparatus, for the precise, continuous and/or real time control of the injection of solvents, or steam, or steam with super-heat, or supercritical steam, with or without solvent, surfactants, or light hydrocarbon assist in a chamber or well for enhanced oil and gas recovery. Embodiments of the present disclosure can advance the implementation of steam injection and steam injection with or without super-heat, or supercritical steam with or without solvent, surfactant, or light hydrocarbon assist, for use in oil and gas recovery. Some embodiments of the present disclosure can be used for the precise, continuous and real time control applied to the injection of solvent, or steam, or steam with super-heat, or supercritical steam, with or without solvent or surfactant assist in a chamber or well with a plurality of controlled zones for increased efficiency in enhanced oil and gas recovery.

In some applications, typically one or two outlets are used to inject the steam or steam with solvents, light hydrocarbons, or surfactants. For example, in Steam Flood and CSS, typically one steam outlet is used in a well. Occasionally, additional single outlet fill-in injection wells can be employed. In SAGD, typically one outlet is used at the heel of the injector or beginning of the chamber and one outlet is used at the toe of the injector or end of the chamber. Crude control of the steam flow is accomplished with steam splitters which typically have fixed flow but in rare occasions can have variable flow. Typically, even in the most advanced SAGD applications only 2 or 3 steam splitters are employed and they typically are not adjustable without being removed from the chamber and being brought to the surface. This renders the control of current state of the art steam injection systems to be poor at best. Many natural steam diversions, such as shale deposits, mud deposits, steam thieves such as fissures and the natural permeability differences in the reservoir make the formation of a chamber less than perfect. Common problems such as "Dog Boning" in the development of chamber shapes can occur. Steam is therefore applied poorly to the new bitumen and energy is wasted. As a result, bitumen or other unconventional energy products can be associated with a higher cost of extraction from the reservoir. This can increase the Steam Oil Ratio (SOR), increase the producer's operating expense (OPEX), and/or erode the producer's already thin production profit. WO patent application no. 2017/151640 teaches a capillary system used to direct and control steam more efficiently into zones of a chamber or well, which is incorporated by reference as though fully set forth herein.

Figure 1C:
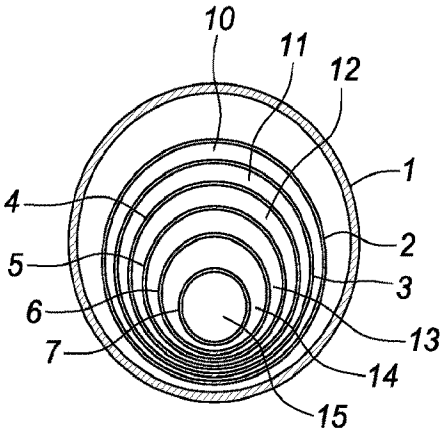
FIG. 1C depicts a cross section of a tube of the completion system depicted in FIG. 1A along the line 1C-1C, in accordance with embodiments of the present disclosure.
Figure 1B:
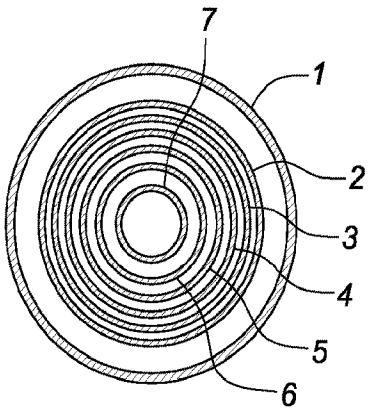
FIG. 1B depicts a cross section of a tube of the completion system depicted in FIG. 1A along the line 1B-1B, in accordance with embodiments of the present disclosure.
Figure 1A:
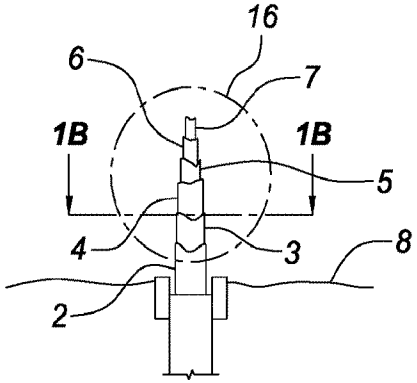
FIG. 1A depicts a completion system and apparatus for the precise control of solvents, or steam, and steam with super-heat, or supercritical steam, with or without solvents, surfactants, or light hydrocarbon assistance in a chamber or well for enhanced oil and gas recovery, in accordance with various embodiments of the present disclosure.
Figure 1A:
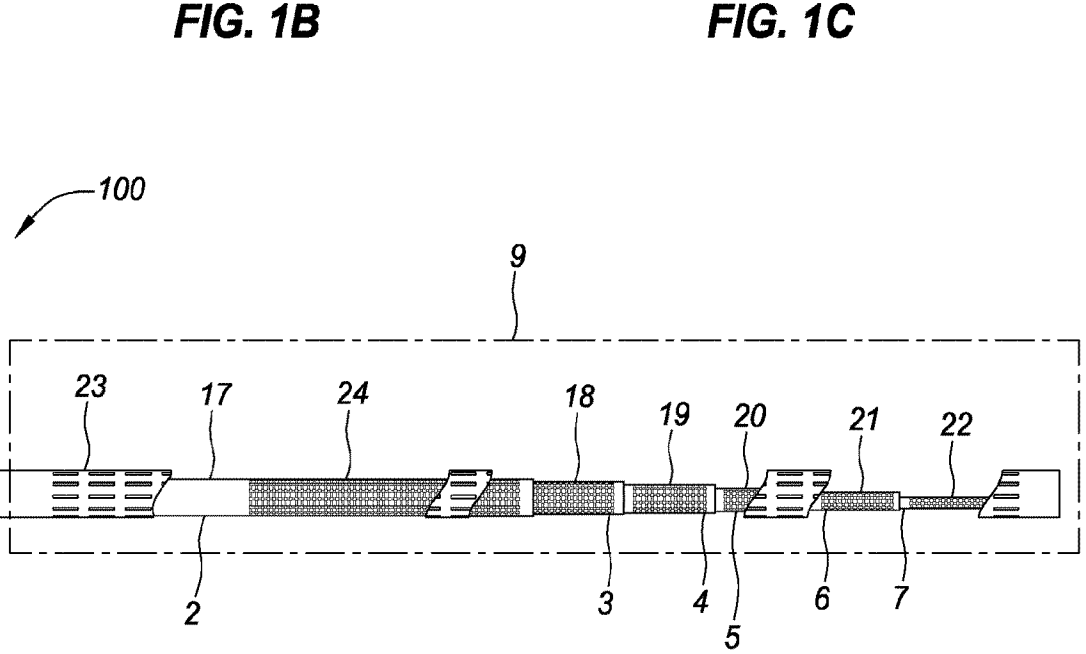

A preferred embodiment in a SAGD application is shown in FIG. 1A. FIG. 1A depicts a completion system 100, method and apparatus for the precise control of solvents, or steam, and steam with super-heat, or supercritical steam, with or without solvents, surfactants, or light hydrocarbon assistance in a chamber or well for enhanced oil and gas recovery. Ground level or surface 8 is pierced by a conduit 1. In an example, the conduit 1 can be a tube or pipe as further discussed herein. As used herein, the terms "tube" and "pipe" have their ordinary meanings as known to one of skill in the art and are not intended to mean the same thing. The tube or pipe 1 can be part of what is known as a completion system 100 in the oil industry. The goal of this completion system 100 is to deliver multiple flow levels of super-heated, supercritical or saturated steam to multiple zones in a chamber area 9 for precise control of bitumen recovery. The chamber area 9 is shown as encompassed by the dotted line section. Only the steam injection line is shown in FIG. 1A. In a typical SAGD chamber, there would also be a second return line known as a producer, but for simplicity this feature is not shown in FIG. 1A.

Tube or pipe 1, as shown in a cross-sectional view along lines 1B-1B and 1C-1C in FIGS. 1B and 1C is comprised of a series of pipes or tubes in the tube or pipe 1. FIG. 1B is a cross-sectional view of the tube or pipe 1 depicted in FIG. 1A along line 1B-1B. As depicted in FIG. 1B, in an example, the tube or pipe 1 can be concentrically disposed about a second tube or pipe 2, which can be concentrically disposed about a third tube or pipe 3, which can be concentrically disposed about a fourth tube or pipe 4, which can be concentrically disposed about a fifth tube or pipe 5, which can be concentrically disposed about a sixth tube or pipe 6, which can be concentrically disposed about a seventh tube or pipe 7. Although 7 tubes or pipes are depicted, the system can include greater than or fewer than seven tubes or pipes. Tubes or pipes 2, 3, 4, 5, 6 and 7 can be standard tube or pipe sizes and together can form the completion system 100. In an example, the tube or pipe 1 can have an inner diameter of 8.63 inches, the second tube or pipe can have an outer diameter of 7.025 inches, the third tube or pipe can have an outer diameter of 6.256 inches, the fourth tube or pipe can have an outer diameter of 5.410 inches, the fifth tube or pipe can have an outer diameter of 4.499 inches, the sixth tube or pipe can have an outer diameter of 3.473 inches, and the seventh tube or pipe can have an outer diameter of 2.231 inches. However, the size of the tubes or pipes can be larger or smaller than the above dimensions, which are only provided for exemplary purposes. In some embodiments, each one of the tubes or pipes can have a wall thickness of 0.188 inches. However, the wall thickness of each one of the pipes can be less than or greater than 0.188 inches.

FIG. 1C depicts a cross-sectional view of the completion system 100 depicted in FIG. 1A, along line 1C-1C, according to various embodiments of the present disclosure. The tubes or pipes can define separated cavities 10, 11, 12, 13, 14, and 15 as shown in section 1C-1C, depicted in FIG. 1C. In an example, the cavity 10 can be defined by an inner surface of the second tube or pipe 2 and an outer surface of the third tube or pipe 3; the cavity 11 can be defined by an inner surface of the third tube or pipe 3 and an outer surface of the fourth tube or pipe 4; the cavity 12 can be defined by the inner surface of the fourth tube or pipe 4 and an outer surface of the fifth tube or pipe 5; the cavity 13 can be defined by an inner surface of the fifth tube or pipe 5 and an outer surface of the sixth tube or pipe 6; the cavity 14 can be defined by an inner surface of the sixth tube or pipe 6 and an outer surface of the seventh tube or pipe 7; and the cavity 15 can be defined by an inner surface of the seventh tube or pipe 7. These cavities 10, 11, 12, 13, 14, 15 can be used to deliver solvent, or steam injection with or without super-heat, or supercritical steam, with or without solvent, surfactant, or light hydrocarbon assist, for use in oil and gas recovery. The cavities 10 to 15 and tube or pipe sections 1 to 7 shown in section 1C-1C can be capped or sealed on the surface as shown at location 16. Cavities 10, 11, 12, 13, 14 and 15 are separated in well area 9 and are allowed to exhaust into effective zones 17, 18, 19, 20, 21, and 22. Seals or packers are used but not shown for clarity between the cavities 10 to 15 to make up the independent well zone injection areas. In an example, a seal or packer can be disposed at a distal end of each one of the cavities 10 to 15 to seal the distal end of the cavity.

The quantity of zones is only limited by a diameter of the tube or pipe 1 and the chosen clearance of the tubes or pipes contained inside tube or pipe 1. Although 6 zones are shown in FIG. 1, greater than 10 zones are possible. Greater than 2 zones and equal to or less than 7 zones can be included in a preferred embodiment per completion. The tube or pipe 1 can include a slotted casing portion 23 to promote steam flow into the well. For example, as depicted, the tube or pipe 1 can define slots that extend through a wall of the tube or pipe 1, causing an exterior of the tube or pipe 1 to be in fluid communication with an interior of the tube or pipe 1. The slotted casing portion 23 can be disposed along a distal portion of the tube or pipe 1. In some embodiments, the slots in the slotted casing portion 23 can extend longitudinally along a longitudinal axis of the slotted casing portion 23, circumferentially about the longitudinal axis of the slotted casing portion 23, and/or can extend helically about the longitudinal axis of the slotted casing portion 23. As depicted, in some embodiments, the distal portion of each one of the tubes or pipes 2 to 7 can include perforated portions that cause a respective one of the cavities 10 to 15 to be in fluid communication with one of zones 17, 18, 19, 20, 21, 22. In an example, the distal portion of each one of the tubes or pipes 2, 3, 4, 5, 6, 7, can include screen mesh shown, which can be used to promote steam flow into the well. For example, with particular reference to tube or pipe 2, the tube or pipe 2 can include screen mesh 24 disposed along a length of the distal portion of the tube or pipe 2, causing the distal portion of the tube or pipe 2 to be in fluid communication with zone 17. As depicted, the tubes or pipes 3, 4, 5, 6, 7 can also include screen mesh disposed along a length of the distal portion of each one of the tubes or pipe 3, 4, 5, 6, 7.

Figure 2:
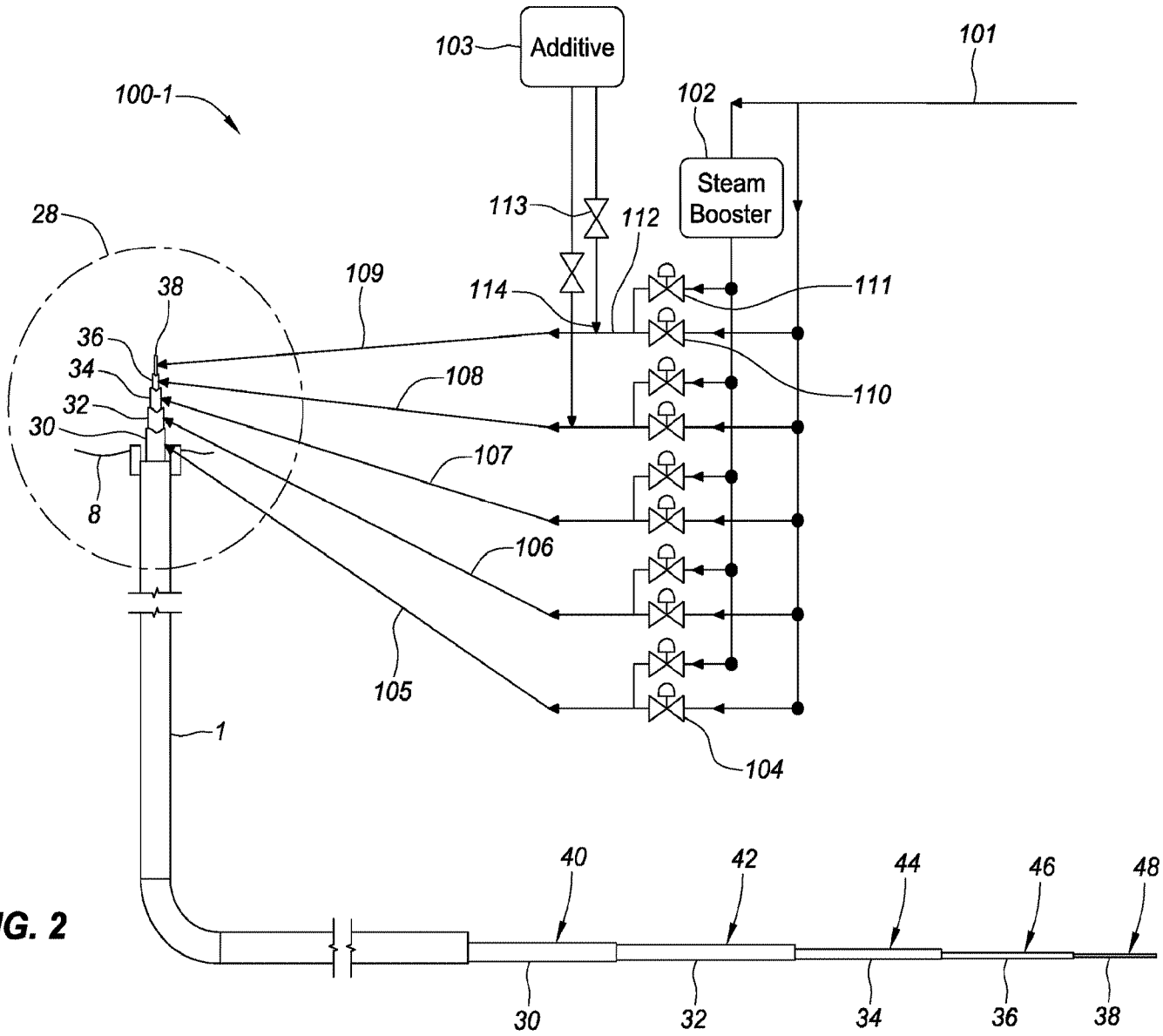
FIG. 2 depicts a control valve, steam booster and additive system and apparatus for enhanced oil and gas recovery, in accordance with embodiments of the present disclosure.

FIG. 2 depicts a control valve, steam booster and additive system and apparatus for enhanced oil and gas recovery, in accordance with embodiments of the present disclosure. FIG. 2 depicts a location 28 where pipes or tubes 30, 32, 34, 36, and 38 are capped and isolated to form injection zones 40, 42, 44, 46, and 48 in the chamber. FIG. 2 depicts a cutaway of the pipes or tubes 30, 32, 34, 36, and 38 at location 28. However, in some embodiments, a manifold can be configured to transfer a fluid (e.g., steam) from conduits 105, 106, 107, 108, and 109, further discussed herein, to the pipes or tubes 30, 32, 34, 36, 38. The zones are penetrated at surface location 28 and are in communication with conduits 105, 106, 107, 108 and 109, respectively.

Solvent and/or steam with or without super-heat or supercritical steam, with or without solvent, surfactant, or light hydrocarbon assist, for use in oil and gas recovery is communicated through conduit 101 to a series of control valves (e.g., control valve 104). Twelve control valves are shown in FIG. 2. All control valves will be referred to as being the same or similar to control valve 104 unless numbered differently to aid in understanding this embodiment. In some embodiments, the system can include a steam booster 102 and/or an additive system 103. The control valves 104, steam booster 102, and additive systems 103 can typically be disposed above the surface of the well.

Conduit 101, if carrying saturated steam, can be in communication with steam booster 102 which could be a super-heater. A blend of saturated heat in this embodiment from conduit 101, the flow of which can be controlled via valve 110 and superheated steam, the flow of which can be controlled via valve 111 may be mixed to generate the desired steam quality or superheat condition at location 112 before additional additives such as surfactants or solvents are added per conduit or zone in this example at location 114 through control valve 113. It should be understood that every zone and conduit could have any combination of steam quality and additives even though conduit 109 is the only conduit used as an example in this embodiment. If supercritical steam is transferred through conduit 101, steam booster 102 may not be included in that embodiment and/or may be included, but may remain inactive.

Figure 3:
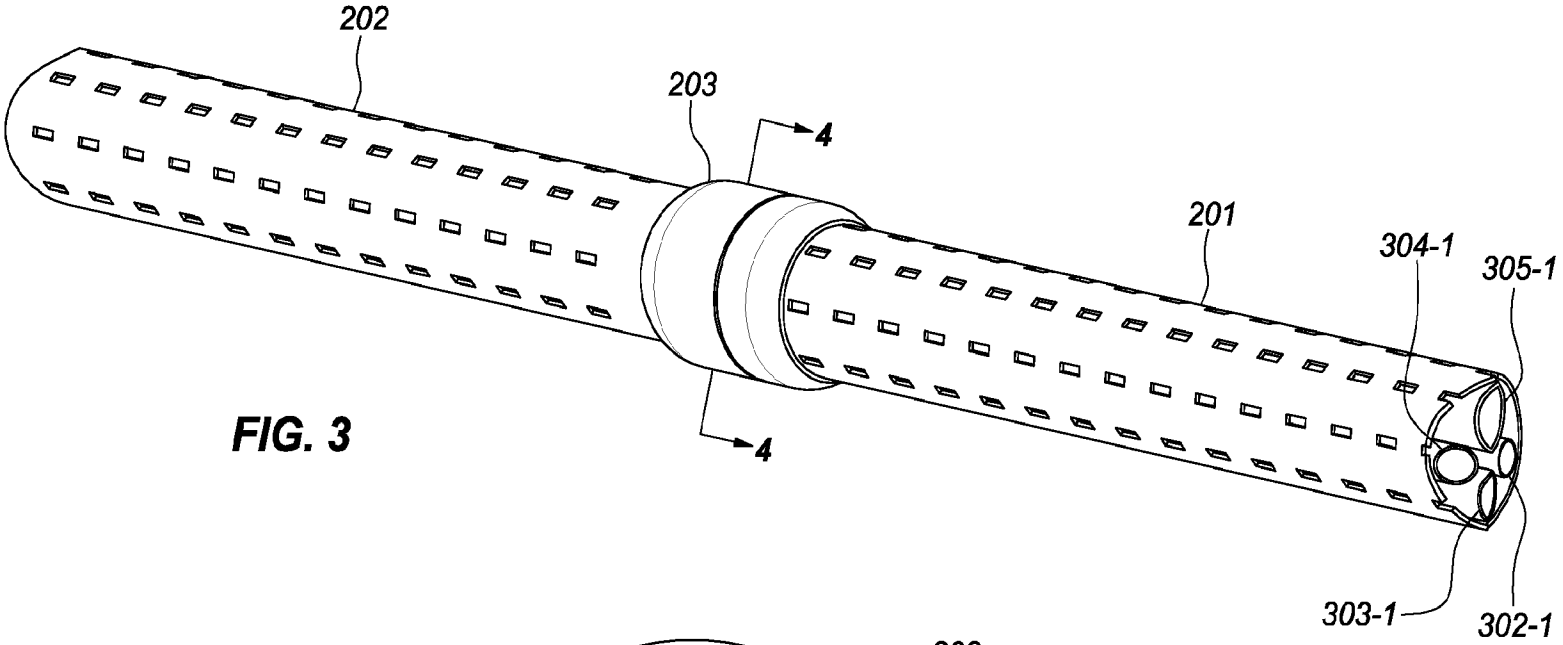
FIG. 3 depicts a second completion system and apparatus that includes a coupling for the precise control of solvents, or steam, and steam with super-heat, or supercritical steam, with or without solvents, surfactants, or light hydrocarbon assistance in a chamber or well for enhanced oil and gas recovery, in accordance with various embodiments of the present disclosure.
Figure 4:
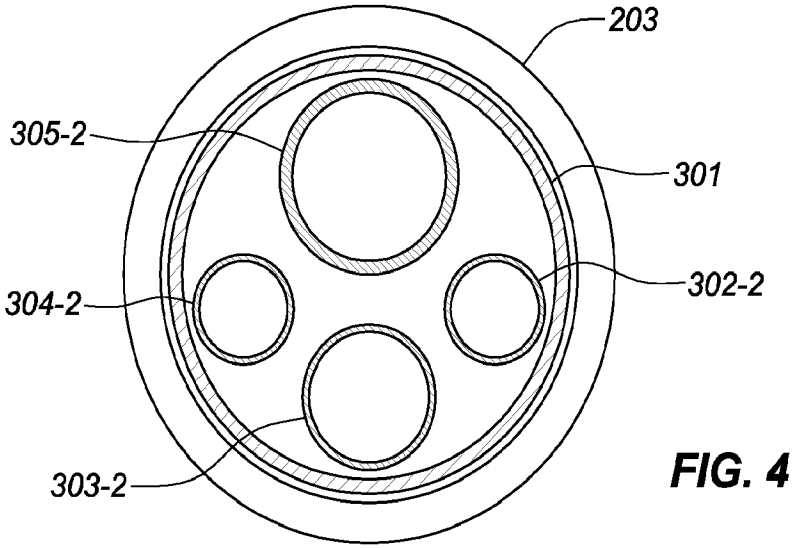
FIG. 4 depicts a cross-sectional view of the completion system and apparatus in FIG. 3 along line 4-4, in accordance with various embodiments of the present disclosure.
Figure 5:
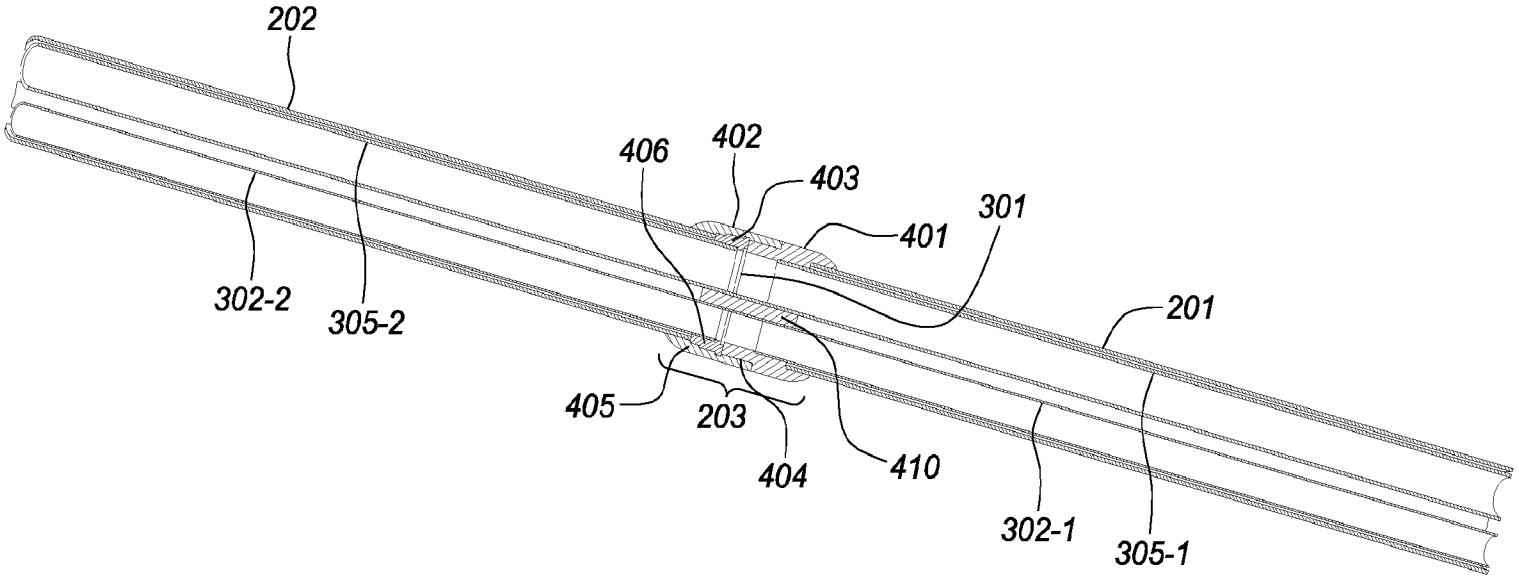
FIG. 5 depicts a longitudinal cross-sectional view of the completion system in FIG. 3, in accordance with various embodiments of the present disclosure.

FIG. 3 depicts a second completion system and apparatus that includes a coupling for the precise control of solvents, or steam, and steam with super-heat, or supercritical steam, with or without solvents, surfactants, or light hydrocarbon assistance in a chamber or well for enhanced oil and gas recovery, in accordance with various embodiments of the present disclosure. In an example, FIG. 3 shows another embodiment of a multizone completion. Two sections 201 and 202 are shown. FIG. 3 depicts a coupling 203 used to connect the two sections 201 and 202. As many sections as needed can be coupled together in a continuous chain to match the required well depth and length. Section 202 continues through these additional couplings 203 to the chamber 9 shown in FIG. 1. The completion of the zones in chamber 9 is the same in both embodiments described in this disclosure. Section 202 and 201 are joined together via a leak proof seal by coupling 203. In an example, the leak proof coupling 203 can fluidly couple tubes or pipes 302-1, 303-1, 304-1, 305-1 (FIG. 3) in the first section 201 to corresponding tubes or pipes 302-2, 303-2, 304-2, 305-2 (FIG. 4) in the second section 202. Tubes or pipes 303-2, 304-2 are depicted in FIG. 4 and tubes or pipe 302-2, 305-2 are depicted in FIGS. 4 and 5. Section 4-4 is detailed in FIG. 4. The coupling 203 is discussed in more detail with respect to FIG. 5.

FIG. 4 depicts a cross-sectional view of the completion system in FIG. 3 along line 4-4, in accordance with various embodiments of the present disclosure. FIG. 4 shows 4 zones. Each of the four zones is associated with a respective one of tubes or pipes 302-2, 303-2, 304-2, and 305-2. The tubes or pipes 302-2, 303-2, 304-2, 305-2 are depicted as being disposed in a lumen defined by coupler 203. More pipes or tube zones can be added and are limited only by the overall pipe or tube diameter and the diameter of the contained zones. A preferred embodiment can include greater than 2 zones but equal to or less than 6 zones. Seal 301 is shown as a wafer (e.g., disk) that seals zones 302, 303, 304, and 305.

FIG. 5 depicts a cutaway of coupling 203. Tubes or pipes 302-1 and 305-1 are depicted as being sealed with corresponding tubes or pipes 302-2, 305-2 by wafer 301 through compression applied by coupling nut 402 as it is pulled up to a compressive load against receiver 401. In an example, the first section 201 and the second section 202 can include one or more alignment keys 410 disposed at an interface between the first section 201 and the second section 202. The alignment keys 410 can be configured to ensure that the first section 201 and the second section 202 are rotationally aligned with one another such that the tubes or pipes 302-1 and 305-1 (and although not shown tubes or pipes 303-1, 304-1) are fluidly coupled with respective ones of corresponding tubes or pipes 302-2, 305-2 and tubes or pipes 303-2, 304-2, although not shown).

In some embodiments, the first section 201 and the second section 202 can be slid together such that the one or more alignment keys 410 disposed at the interface between the first section 201 and the second section 202 are aligned. In an example, the receiver 401 can include a first alignment key or feature configured to align with a second alignment key or feature included on a coupling receiver 403. In some embodiments, upon alignment of the first section 201 with the second section 202, the coupling nut 402 can be threaded onto the receiver 401. In an example, a distal portion of the receiver 401 can include a threaded portion that interfaces with a threaded portion of the coupling nut 402. In an example, an inner surface of a proximal portion of the coupling nut 402 can be threaded and can be configured to thread onto a threaded outer surface of the distal portion of the receiver 401. In some embodiments, the coupling nut 402 and the coupling receiver 403 can include corresponding ledges 405, 406, such that as the coupling nut 402 is threaded onto the receiver 401, a coupling nut ledge 405 can engage a coupling receiver ledge 406. In an example, the coupling nut ledge 405 can circumferentially extend around an interior surface of the coupling nut 402 and the coupling receiver ledge 406 can circumferentially extend around an exterior surface of the coupling receiver 403.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be further appreciated that for conciseness and clarity, spatial terms such as "vertical," "horizontal," "up," and "down" may be used herein with respect to the illustrated embodiments. However, these terms are not intended to be limiting and absolute.

Although at least one embodiment for completions for well zone control has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A system for increased control of steam injection for use in oil and gas recovery in a well, comprising:

a plurality of controllable zones of injection disposed in the well, wherein the plurality of controllable zones include the following:

a primary conduit that houses a plurality of separate conduits, wherein each of the conduits includes a proximal end and a distal end, each of the conduits is configured to carry a separate fluid from the proximal end to the distal end of each respective conduit.

2. A system for increased control of steam injection for use in oil and gas recovery in a well, comprising:

a plurality of controllable zones of injection disposed in the well, wherein the plurality of controllable zones include a primary conduit that houses a plurality of conduits disposed inside of the primary conduit, wherein:

each of the conduits includes a proximal end and a distal end;

the plurality of conduits are fluidly sealed from one another from their respective proximal end to their distal end; and the primary conduit and the plurality of conduits disposed inside of the primary conduit include a plurality of modular sections of conduit fluidly coupled with one another via compression couplings.

3. The system of claim 1, further comprising a control valve system disposed above ground, the control valve system configured to blend saturated steam and superheated steam per zone to generate at least one of a desired level of steam quality per each one of the plurality of controllable zones and a superheat per zone.

4. The system of claim 1, further comprising a control valve system disposed above ground, the control valve system configured to add enhanced bitumen recovery additives via each one of the plurality of controllable zones.

5. The system of claim 1, further comprising a control valve system disposed above ground, the control valve system configured to control solvent injection via each one of the plurality of controllable zones for enhanced oil recovery.

6. The system of claim 1, further comprising a control valve system disposed above ground, the control valve system configured to add at least one of a surfactant and a solvent via each one of the plurality of controllable zones for enhanced oil recovery.

7. The system of claim 1, wherein a number of the plurality of controllable zones of injection disposed in the well is in a range from 3 to 7 controllable zones of injection.

8. The system as in claim 7, wherein each one of the controllable zones of injection is formed via one of the conduits disposed within the primary conduit.

9. The system of claim 1, wherein a number of the plurality of controllable zones of injection disposed in the well is in a range from 3 to 6 controllable zones of injection.

10. The system of claim 1, wherein the primary conduit is a tube.

11. The system of claim 1, wherein the primary conduit is a pipe.

12. The system of claim 1, wherein each one of the conduits is a pipe.

13. The system of claim 1, wherein each one of the conduits is a tube.

14. The system of claim 1, further comprising a control valve system disposed above ground, the control valve system configured to blend saturated steam and superheated steam per zone to generate a desired level of steam quality per each one of the plurality of controllable zones.

* * * * *